United States Patent [19]

Gil

[11] Patent Number: 4,907,519

[45] Date of Patent: Mar. 13, 1990

[54] PROPULSION AIDS FOR ATTACHMENT TO A SWIMMER'S FEET

[76] Inventor: Yoram Gil, 1441 S. Beverly Glen Rd., Los Angeles, Calif. 90024

[21] Appl. No.: 274,396

[22] Filed: Nov. 21, 1988

[51] Int. Cl.[4] ..... A63B 31/00

[52] U.S. Cl. ..... 441/61; 441/64

[58] Field of Search ..... 441/61-64, 441/55; 416/70 R, 72, 73

[56] References Cited

U.S. PATENT DOCUMENTS 4,250,584 2/1981 Korn ..... 441/61

FOREIGN PATENT DOCUMENTS 2575927 7/1986 France ..... 441/64

749221 5/1956 United Kingdom ..... 441/64

*Primary Examiner*—Joseph F. Peters, Jr.

*Assistant Examiner*—Edwin L. Swinehart

*Attorney, Agent, or Firm*—Philip D. Junkins

[57] ABSTRACT

A flipper-type swimming propulsion aid assembly for attachment to the feet of a swimmer to increase the swimmer's effective foot area. The swimming aid for each foot includes a dismantlable frame of generally isosceles triangular configuration having side frame members of substantially equal length which are pivotally joined at the heel end of the frame and at least two cross frame members of progressively greater length adapted at their ends for removable joinder to the side frames with the longest of the cross frame members joining the free ends of the side frame members. The swimming aid also includes a fabric or plastic sheet web component for the frame with the web component being of generally isosceles triangular configuration matching the configuration and size of the frame and including side loops for receiving and maintaining the side frame members and including cross loops for receiving and maintaining the cross frame members. The cross frame members are of lengths such that upon force joinder of their ends to the side frame members the latter members are maintained pivoted outwardly to the maximum extent permitted by the web component and its side loops so that the web component is stretched to its full triangular configuration. The swimming propulsion aid assembly is maintained on the swimmer's foot in abutment with the foot sole by a forward foot strap and by an ankle strap. Through use of the flipper-type swimming propulsion aids of the invention the swimmer, in performing the American crawl stroke or back stroke, is more effectively and forcefully propelled through the water.

6 Claims, 1 Drawing Sheet

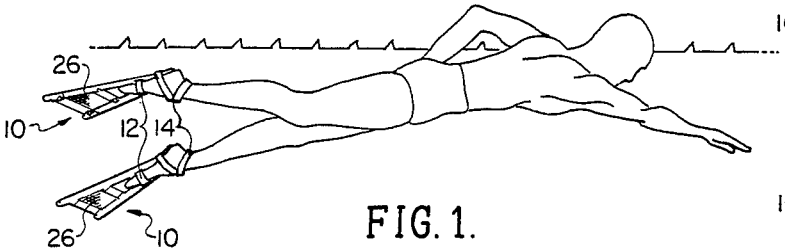
FIG. 1.
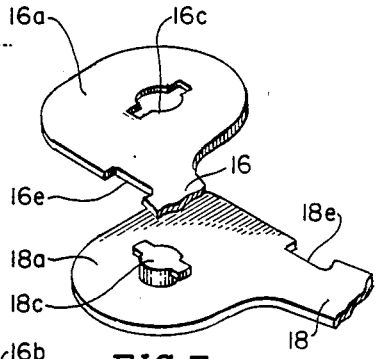
FIG. 7.
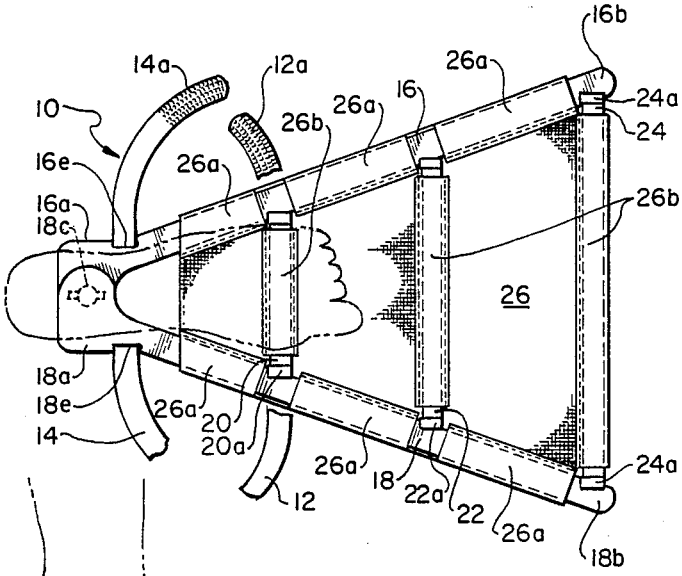
FIG. 2.
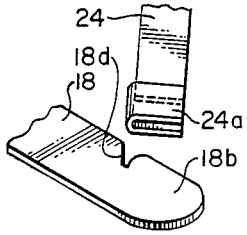
FIG. 6.
FIG. 3.
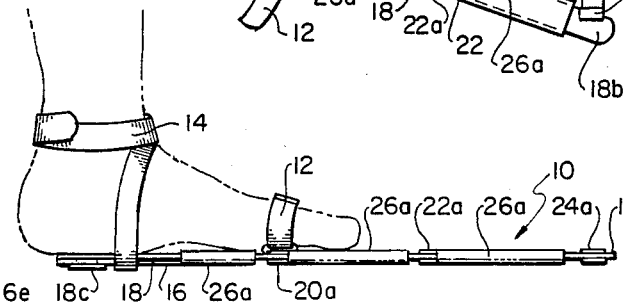
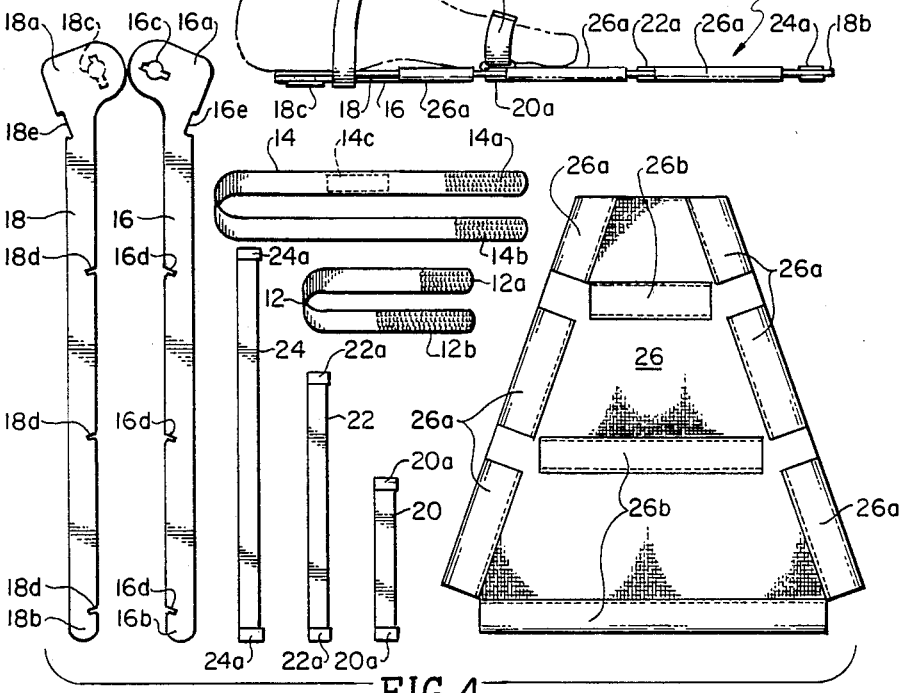
FIG. 4.
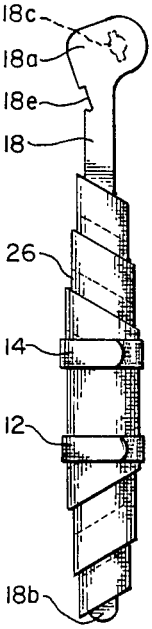
FIG. 5

PROPULSION AIDS FOR ATTACHMENT TO A SWIMMER'S FEET

FIELD OF THE INVENTION

This invention relates to means to be used by a swimmer as an aid to propelling the swimmer through the water. More particularly, the invention relates to light-weight means to be worn on the feet of an untrained or experienced swimmer to assist in propelling such swimmer through the water more rapidly over greater distances with reduced effort.

BACKGROUND OF THE INVENTION

For many years there has been a developing interest in swimming appliances and propulsion aids. Particular attention has been given by swimmers to the design and development of foot gear for use in swimming. One approach to increasing the forward push or thrusting action obtainable from a swimmer's legs and feet has been the provision of swimming shoes. Swimming shoes of one general type have lateral wings that swing outwardly into the plane of the shoe's sole during alternating push or thrust type strokes of the swimmer's legs and that swing toward each other and reside rearwardly of the borders of the shoe sole during a forward or retracting portion of the swimmer's leg stroke so that little or no resisting surfaces of the wings are presented to the water during this movement of the swimmer's leg strokes. Examples of this form of swimmer's foot gear are disclosed in U.S. Pat. No. 1,043,776 granted to G. M. Larson, U.S. Pat. No. 1,506,885 granted to A. Cech and U.S. Pat. No. 1,626,541 granted to J. P. LaRosa.

Another approach to the provision of swimming shoe designs has been proposed in U.S. Pat. No. 1,626,175 granted to J. Zimmer and U.S. Pat. No. 1,983,609 granted to W. T. Hudson. In these patents lateral thrust wings are affixed in hinged manner to the shoe sole along the central longitudinal axis of the sole or to a central plate or platform along the central longitudinal axis thereof with the swimmer's foot strapped to such plate or platform. Again, these swimming aids are utilized where the swimmer utilizes a push or thrust type stroke of the legs followed by forward or retracting movement of the legs and such swimming aids are heavy, cumbersome and unwieldy and frequently come into interfering contact with one-another during the pushing portion of the leg strokes.

A further design for foot gear for use in swimming has been proposed by P. J. Griffin in his U.S. Pat. No. 719,583 wherein lateral water thrust wings are hinged to a beam which is attached to and projects from an anklet ring worn on the swimmer's leg above each ankle. The beam on each of the swimmer's legs extends forwardly from the shin area above the ankle with the lateral wings moving outwardly above the forward portion and toes of each foot during leg thrust motion and inwardly and downwardly to the foot during the retracting portion of each leg stroke. The Griffin swimming gear requires that a strut extend from a metallic portion of a foot socket to the beam supporting the thrust wings to maintain such beam in its forwardly extending orientation from the swimmer's leg. As in the case of the previously described patented swimming aids, the Griffin gear is heavy, cumbersome and unwieldy with the inside thrust wings of each foot-borne structure often interfering with each other.

Still further designs for swimmer's foot gear have been disclosed in U.S. Pat. No. 1,607,857 granted to F. Zukal and U.S. Pat. No. 2,672,629 granted to J. K. Latrell and comprise foot "flipper-type" swimmer's propulsion aids where the effective areas of the soles of the swimmer's feet are increased. With such gear, increased swimming propulsion force is derived during relatively normal flutter kicking action of the swimmer's legs and feet in an extended orientation without a reciprocating action of the legs.

It is an object of the present invention to provide swimming propulsion aids for attachment to each foot of a swimmer with the aids being of light-weight construction and dismantlable for convenient and compact storage.

It is another object of the invention to provide a pair of light-weight swimming propulsion aids for rapid attachment to the feet of a swimmer to assist in propelling the swimmer through the water with a minimum of leg flutter-kick action.

It is still a further object of the invention to provide light-weight dismantlable swimming propulsion aids that may be rapidly assembled and attached to the feet of a swimmer to enable the propelling of the swimmer through the water more rapidly over greater distances with normal flutter-kick action of the swimmer's legs and feet.

It is yet another object of the invention to provide a pair of light-weight swimming propulsion aids for rapid assembly and attachment to the feet of a swimmer with such aids being oriented so as to not interfere with one another during normal flutter kick action of the swimmer's legs.

Other objects and advantages of the invention will become apparent from the following summary and detailed description of a preferred embodiment of the invention taken in conjunction with the accompanying drawing figures.

SUMMARY OF THE INVENTION

The present invention relates to a pair of swimming propulsion aids of "flipper type" for attachment to the feet of a swimmer with the aids or devices being of light-weight construction and capable of rapid assembly from pre-use compact stored or packaged components. The assembled swimming aid for each foot is affixed to the sole of the foot by foot and ankle straps and substantially increases the foot area for assisting the forward propulsion of the swimmer through the water. The propulsion aids of the invention are particularly useful for a swimmer performing the well-known "American crawl" stroke which combines a hand-over-hand arm stroke with a flutter kick of the legs and with the feet lashing upward and backward. The propulsion aids are also useful in performing the backstroke, much like the crawl turned upside down, with the swimmer using a flutter kick.

In accordance with the invention the swimming aid structure or assembly for each foot is comprised of a strong fabric or flexible plastic web component of generally triangular configuration supported on and by a dismantlable frame. The frame is comprised of side frame members, extending in divergent manner from the heel of each foot forwardly along the sole and for a distance beyond the toes, and cross frame members for maintaining the side members in their divergent orientation. The fabric or plastic web component of the assembly is stretched over the assembled frame so that when the swimming propulsion aids are affixed to the swimmer's feet the effective propulsion area of the sole area of each foot is increased by at least double that of the sole area per se. The foot and ankle straps for affixing the swimming aid assemblies to the swimmer's feet are preferably comprised of strong non-stretchable fabric material with VELCRO® brand interlocking hook and eye fastener means.

BRIEF DESCRIPTION OF THE DRAWING FIGURES

FIG. 1 is a side view showing a pair of the swimming propulsion aids of the invention in use upon the feet of a swimmer;

FIG. 2 is a top plan view of one of the swimming propulsion aids of the invention with a swimmer's left foot shown in phantom in its position for attachment of the swimming aid by the associated foot and ankle straps thereof;

FIG. 3 is an edge view of the swimming propulsion aid of FIG. 2;

FIG. 4 is a top plan view of the disassembled components from which each swimming propulsion aid is readily formed;

FIG. 5 is a view of one of the swimming propulsion aids of the invention in its pre-assemble, rolled storage form;

FIG. 6 is a perspective view of the assembly system for attachment of cross frame members to the side frame members of the swimming propulsion aid; and FIG. 7 is a perspective view of the pivotal ends of the side frame members of the swimming propulsion aid prior to their assembly.

DETAILED DESCRIPTION OF THE PREFERRED EMBODIMENT

Referring initially to FIG. 1 there is illustrated in a partial showing a swimmer utilizing a pair of the swimming propulsion aids 10 of the invention mounted to the feet of the swimmer. As shown, the swimmer's legs are extended rearwardly in position to effect a flutter kick of each leg for use in performing the "American crawl" stroke with the feet and attached propulsion aids lashing upward and backward. Each of the swimming propulsion aids 10 is maintained on the swimmer's foot by foot straps 12 and ankle straps 14.

In FIGS. 2 and 3 there is shown, in a top plan view and in a side edge view, respectively, a swimming propulsion aid 10 of the invention with a swimmer's left foot shown in phantom in its position for attachment of the propulsion aid to the foot by a foot strap 12 and ankle strap 14. The propulsion aid 10 is comprised of a dismantlable triangular frame and a web of strong fabric (or flexible sheet plastic) material supported on and by the frame. The triangular frame is comprised of side frame members 16 and 18 (of equal length) which are pivotally affixed to one-another at the heel end of the frame, and spaced cross frame members 20, 22 and 24 of progressively longer length from the heel ends **16*a* and 18*a* of the side frame members to their extended spaced ends 16*b* and 18*b*. The side frame member 16 at its heel end 16*a* includes a key slot 16*c* into which a mating key projection 18*c* of side frame member 18 (at its heel end 18*a*) is inserted and rotated to provide the pivotal connection between side frame members 16 and 18 at their heel ends. The side frame members 16 and 18 are also each provided with assembly notches 16*d* and 18*d*, respectively, into which the end assembly U-shaped brackets 20*a*, 22*a* and 24*a* of the cross frame members 20, 22 and 24, respectively, are inserted during assembly of the propulsion aid 10** as described hereinafter.

The triangular web of fabric (or flexible sheet plastic) material 26 forming the increased flipper area of the propulsion aid 10 of the invention is maintained on the triangular frame by side fabric loops **26*a* for receiving and retaining side frame 16 and 18 and cross fabric loops 26*b* for receiving and retaining cross frame members 20, 22 and 24. The fabric or sheet plastic material forming the side and cross loops may be sewn, heat welded or otherwise affixed to the triangular web of material 26. The foot and ankle straps 12 and 14 may be of any suitable flexible (non-stretchable) fabric (such as canvas) or plastic material. End portions 12*a* and 12*b* of the foot strap 12 and the end portions 14*a* and 14*b* of ankle strap 14 are provided with mating VELCRO® brand fastening means whereby when such straps are appropriately wrapped around the foot and ankle of the swimmer (see FIG. 3) the mating VELCRO® hook and eye fasteners interact in well known fashion to secure the straps and thus the propulsion aid 10, in place. The foot strap 12 is maintained fixed to the triangular web of material 26 by locating the central portion of such strap within the cross loop 26*b* closest to the heel end of the propulsion aid. The ankle strap 14 is maintained in place at the heel end of the propulsion aid by locating such strap in strap notches 16*e* and 18*e* in the heel ends 16*a* and 18*a*, respectively, of the side frame members 16 and 18**.

FIG. 4 is a top plan view of the disassembled components from which each swimming propulsion aid of the invention is readily formed. FIG. 5 shows the components of a swimming propulsion aid in disassembled and rolled storage form, i.e., the side frame members 16 and 18 and cross frame members 20, 22 and 24 rolled within the triangular web material and maintained in rolled storage form by straps 12 and 14 and their respective Velcro® fastener means. The longer ankle strap 14 may include one or more supplemental Velcro® fastener components **14*c*** so that such strap may surround the rolled web material in several turns and fasten upon itself to maintain the swimming propulsion aid components in rolled form.

FIG. 6 is a perspective view of the assembly system for attachment of the ends of the cross frame members to the side frame members of the swimming propulsion aid 10. As shown, an end of the longest cross frame member 24, with its affixed U-shaped end assembly bracket **24*a*, is in position for insertion of the bracket into assembly notch 18*d* at the end 18*b* of side frame member 18. FIG. 7 is a perspective view of the assembly system for pivotal attachment of the heel ends 16*a* and 18*a* of side frame members 16 and 18**.

The above described embodiment of the swimming propulsion aid of the invention is easily assembled from a packaged or stored assemblage of its components. The triangular web material 26 is laid out and the side frame members 16 and 18 inserted through the side loops **26*a*. The key projection 18*c* in the heel end 18*a* of side frame member 18 is inserted in the key slot 16*c* in the heel end 16*a* of side frame member 16 and rotated to lock the side frame members, at their heel ends, together in pivotal fashion. Thereafter, the short, intermediate and long cross frame members 20, 22 and 24 are successively inserted through the cross loops 26*b* with the U-shaped end brackets 20*a*, 22*a* and 24*a* inserted into an assembly notch 16*d* of side frame member 16. The other end of each cross frame member, via its respective U-shaped end bracket 20***a*, 22*a* and 24*a*, is then strapped into its respective assembly notch 18*d* of side frame member 18.

To mount the swimming propulsion aid of the invention to a swimmer's foot, the foot strap 12 is inserted through the cross fabric loop 26*b* through which the shortest cross frame member 20 is positioned. Such strap is thereafter affixed around and across the top of the foot with the ends of such strap joined by their Velcro® brand fastener hook and eye components. The ankle strap 14 is located in strap notches 16*e* and 18*e* in the heel ends 16*a* and 18*a*, respectively, of side frame members 16 and 18, with the ends of such strap then drawn over the foot, across each other in front of the ankle and thence around the leg for fastening, via the Velcro® brand fastener means, at the rear of the leg as particularly shown in FIG. 3.

The side and cross frame members are preferably made of thin metallic strips with the resulting swimming propulsion aid being of relatively light weight structure. With the swimming propulsion aids of the invention mounted to a swimmer's feet, the swimmer is assisted in propelling himself or herself through the water with a minimum of leg flutter kick action because of the substantial increase in effective foot area of the swimmer.

While the present invention has been described with reference to a preferred embodiment thereof, it is obvious that modifications and alterations of such embodiment will occur to others skilled in the art upon their reading and understanding of this specification. It is therefore to be understood that the present invention includes all such modifications and alterations, and equivalents thereof, being limited only by the scope of the following claims.

What I claim is:

1. In a flipper-type swimming propulsion aid assembly for attachment to each foot of a swimmer to increase the swimmer's effective foot area:

(a) a dismantlable frame comprised of side frame members of substantially equal length, said side frame members being pivotally joined at a heel end of said frame, and at least two cross frame members of progressively longer lengths adapted for removal joinder to said side frame members, the longest of said cross frame members joining free ends of the side frame members at a toe end of said frame with the result that said frame is of generally isosceles triangular configuration;

(b) a web component for said frame comprised of a flexible material selected from the group consisting of fabric and sheet plastic materials, said web component being of generally isosceles triangular configuration matching the configuration and size of said frame, said web component including side loops for receiving and maintaining the side frame members and including cross loops for receiving and maintaining the cross frame members, said cross frame members being of lengths such that upon the forced joinder of their ends to said side frame members said latter members are maintained pivoted outwardly to the maximum extent permitted by the web component and its side loops whereby said web component is stretched to its full triangular configuration;

(c) a foot strap extending through one of the cross loops of said web component for attachment to said web component and of a length in its opposite end portions extending from said cross loop sufficient to surround the forward portion of the swimmer's foot and connectively mate atop said foot; and (d) an ankle strap affixed to said side frame members at the heel end of said frame and of a length in its opposite end portions sufficient to cross over the swimmer's foot in front of the ankles, cross around the swimmer's ankle and connectively mate behind the swimmer's leg.

2. In a flipper-type swimming propulsion aid assembly for attachment to each foot of a swimmer as claimed in claim 1 wherein the side frame members are each provided at their inner edge with like assembly notches and the cross frame members are each provided with U-shaped assembly brackets at each end thereof, said assembly brackets of each cross frame member being inserted into respective mating assembly notches of said side frame members in forced joinder therewith with said side frame members maintained pivoted outwardly to the maximum extent permitted by the web component and its side loops.

3. In a flipper-type swimming propulsion aid assembly for attachment to each foot of a swimmer as claimed in claim 1 wherein the foot strap attached to said web component of said assembly, and the ankle strap affixed to said side frame members in their respective end portions at the heel end of said frame, terminate in mating interlocking hook and eye fastener means.

4. In a flipper-type swimming propulsion aid assembly for attachment to each foot of a swimmer as claimed in claim 1 wherein one of said side frame members at its heel end includes a key slot and the other of said side frame members at its heel end includes a mating key projection with said key projection when seated and locked in said key slot resulting in the pivotal joinder of said side frame members at the heel end of said frame.

5. In a flipper-type swimming propulsion aid assembly for attachment to each foot of a swimmer as claimed in claim 1 wherein said side frame members at the heel end of said frame each include a strap notch within which the ankle strap in its mid-portion is seated to provide the means for affixing said strap to said side frame members when the end portions of said strap are connectively mated behind the swimmer's leg.

6. In a flipper-type swimming propulsion aid assembly for attachment to each foot of a swimmer as claimed in claim 1 wherein the dismantlable frame of said assembly including the side frame members and cross frame members when dismantled and wrapped with said web component and secured with said foot and ankle straps form a compact package for storage.

* * * * *